US005679105A

United States Patent [19]

Vittone et al.

[11] Patent Number: 5,679,105

[45] Date of Patent: Oct. 21, 1997

[54] APPARATUS FOR USE DURING THE PERFORMANCE OF SQUAT-JUMP TYPE EXERCISES

[76] Inventors: Suzanne R. Vittone; Larry W. Vittone, both of Rt. 1, Box 55, Hurley, Wis. 54534

[21] Appl. No.: 601,591

[22] Filed: Feb. 14, 1996

[51] Int. Cl.[6] ..... A63B 21/06; A63B 25/035

[52] U.S. Cl. ..... 482/93; 482/15; 482/77; 482/78; 482/96; 482/98; 482/110; 482/148

[58] Field of Search ..... 482/14, 15, 87, 482/78, 93, 94, 96, 104, 105, 106, 110, 129, 130, 148; 434/247, 248

[56] References Cited

U.S. PATENT DOCUMENTS

| | | | |
|---|---|---|---|
| 1,617,665 | 2/1927 | Cashoty | 482/77 |
| 2,871,016 | 1/1959 | Rapaport | 482/77 |
| 3,119,626 | 1/1964 | Strader | 482/77 |
| 3,427,019 | 2/1969 | Brown | 482/77 |
| 3,593,995 | 7/1971 | Eckstrom | 482/110 |
| 3,751,032 | 8/1973 | Boyle | 482/77 |
| 4,018,442 | 4/1977 | Galler | 482/106 |
| 4,750,739 | 6/1988 | Lange | 482/104 |
| 4,813,664 | 3/1989 | Vroulis | 482/14 |
| 4,863,163 | 9/1989 | Wehrell | 482/129 |
| 5,199,936 | 4/1993 | Moye | 482/148 |
| 5,352,176 | 10/1994 | Huang | 482/77 |
| 5,512,029 | 4/1996 | Barnard et al. | 482/129 |

*Primary Examiner*—Richard J. Apley
*Assistant Examiner*—Victor K. Hwang
*Attorney, Agent, or Firm*—Michael E. McKee

[57] ABSTRACT

An apparatus for use during the performance of squat-jump type exercises utilizes a weight-laden frame which is grasped by the hands of a user during the performance of the exercise routine and leg members associated with the frame which are spring-biased from a retracted position toward an extended position. During an exercise routine performed with the apparatus, the apparatus is lifted from the floor during a jump phase of the routine and is returned to the floor during a rebound phase of the routine. The spring-biased leg members of the apparatus cushion the effects of the weight-laden frame as the apparatus is returned into contact with the floor and facilitate the lifting of the apparatus during a subsequent jump phase of the routine.

20 Claims, 3 Drawing Sheets

APPARATUS FOR USE DURING THE PERFORMANCE OF SQUAT-JUMP TYPE EXERCISES

BACKGROUND OF THE INVENTION

This invention relates generally to exercise equipment and relates, more specifically, to means for enhancing the physical conditioning of an individual during the performance of an exercise routine.

The type of exercise routine with which this invention is concerned is a squat-jump type of exercise routine wherein an individual jumps vertically from a floor from a squat position during a jump phase of the routine and returns to a squat position during a rebound phase of the routine. Normally, the legs of the individual are straightened during the jump phase and are returned to a bent condition during the rebound phase to both cushion the individual's return to the floor and to prepare for a subsequent jump.

If desired, an individual may attach weights to his body by way of, for example, a weighted vest, to render the squat-jump exercise routine more challenging. However, such weights add to the weight that the user's joints and muscles must support during the entire cycle of the exercise routine and are thereby likely to expose the joints and muscles to undue stress.

It is an object of the present invention to provide a new and improved apparatus for use during the performance of a squat-jump type of exercise routine for increasing the user's strength and agility while reducing the risk (to the user) of a stress-related injury during the performance of the exercise routine.

One more object of the present invention is to provide such an apparatus which supplements the weight borne by the individual's muscles during the jump phase of the routine yet relieves some of the stress to which the user's joints would otherwise be exposed during selected periods of the routine.

Another object of the present invention is to provide such an apparatus whose weight is borne by the floor during the outset of the jump phase of the routine and is returned to the floor near the end of the rebound phase of the routine.

Still another object of the present invention is to provide such an apparatus which is grasped by the individual during an exercise routine.

Yet another object of the present invention is to provide such an apparatus to which weights can be readily added or removed.

A further object of the present invention is to provide such an apparatus which is uncomplicated in construction and relatively easy to use.

SUMMARY OF THE INVENTION

This invention resides in an apparatus for use during the performance of a squat-jump type of exercise routine wherein the exercise routine includes a jump phase during which the user lifts the apparatus from the floor and a rebound phase during which the user returns the apparatus to the floor.

The apparatus includes a frame within which a user stands for the performance of a squat-jump type of exercise routine, and the frame includes hand grips with which the apparatus is lifted from the floor by the user during the jump phase of the exercise routine and is returned to the floor during the rebound phase of the exercise routine. The hand grips are disposed on opposite sides of the user as the user stands within the frame. The apparatus also includes leg members for engaging the floor and through which the weight of the frame is transferred to the floor when the apparatus is rested thereon, and the leg members are associated with the frame so that each leg member is movable relative to the frame between an extended condition and a retracted condition. Means are associated with the frame for biasing the leg members from the retracted condition toward the extended condition so that when the apparatus is in a spaced relationship above the floor, the leg members are maintained in the extended condition by the biasing means and so that when the apparatus is lowered to the floor during the rebound phase of the exercise routine, the leg members engage the floor and are permitted to move relative to the frame toward the retracted position under the weight of the frame and in opposition to the force of the biasing means to thereby cushion the impact of the apparatus against the floor.

DETAILED DESCRIPTION OF THE ILLUSTRATED EMBODIMENT

Figure 1:
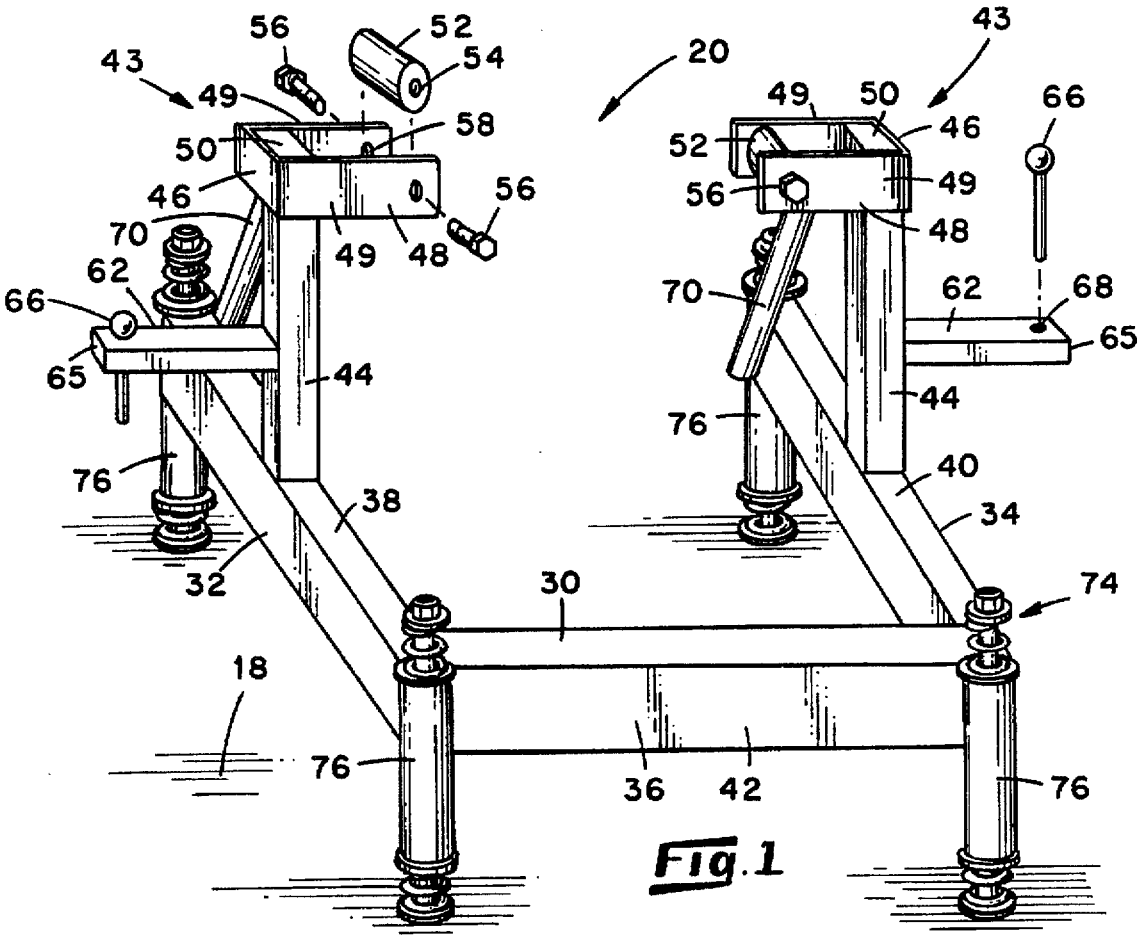
FIG. 1 is a perspective view of an embodiment of an apparatus within which features of the present invention are embodied.

Turning now to the drawings in greater detail, there is illustrated in FIG. 1 an embodiment, generally indicated 20, of an apparatus for use during a squat-jump type of exercise routine wherein an individual repeatedly jumps vertically from the floor 18 from a squat position. As used herein, the term "floor" is intended to include the ground or some other suitable underlying support surface, as well as the floor of a room or building. At the outset of a jump, or jump phase, of such an exercise routine, the individual stands in a squat position with his knees in a bent condition, and during the jump phase of the routine, the individual jumps vertically from the squat position so that his feet leave the floor and his legs are moved to a substantially straight condition. As the individual returns to the floor (under the influence of gravity) during a rebound phase of the routine, the feet strike the floor and the legs are permitted to bend under the weight of the individual to cushion the return of the individual to the floor and to return the individual to a squat position in preparation for a subsequent repetition of the exercise. Preferably, the rebound phase of the routine is effected in a single, fluid-like motion to enhance the cushioning effect of the legs as the legs are bent at the knees.

As will be apparent herein, the apparatus 20 is held by the hands of the user throughout the jump and rebound phases of the exercise routine. Furthermore, the apparatus 20 is bodily lifted from the floor 18 during the initial moments of the jump phase of the routine and is returned to the floor 18 during the final moments of the rebound phase of the routine.

Figure 2:
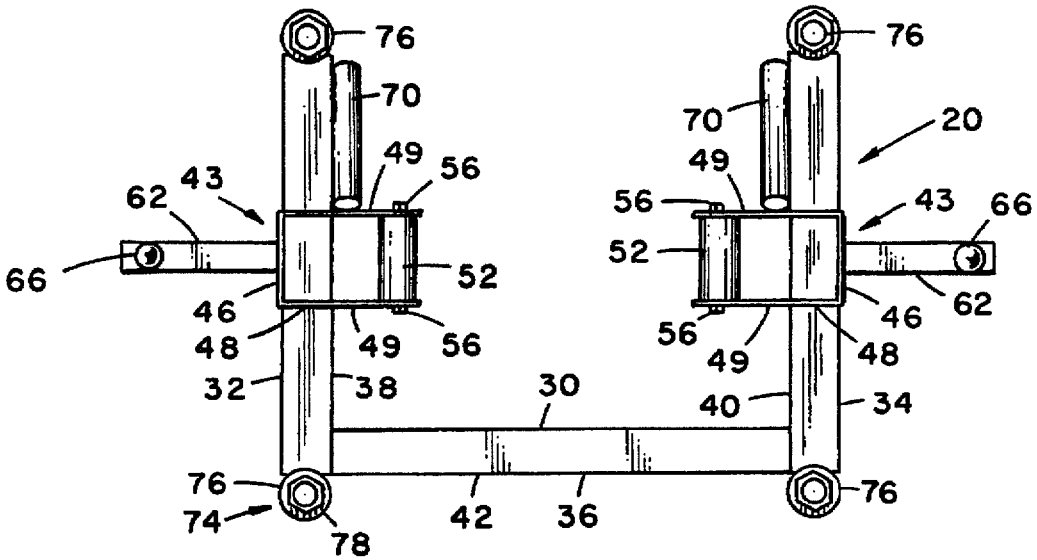
FIG. 2 is a plan view of the FIG. 1 apparatus, as seen from above in FIG. 1.
Figure 3:
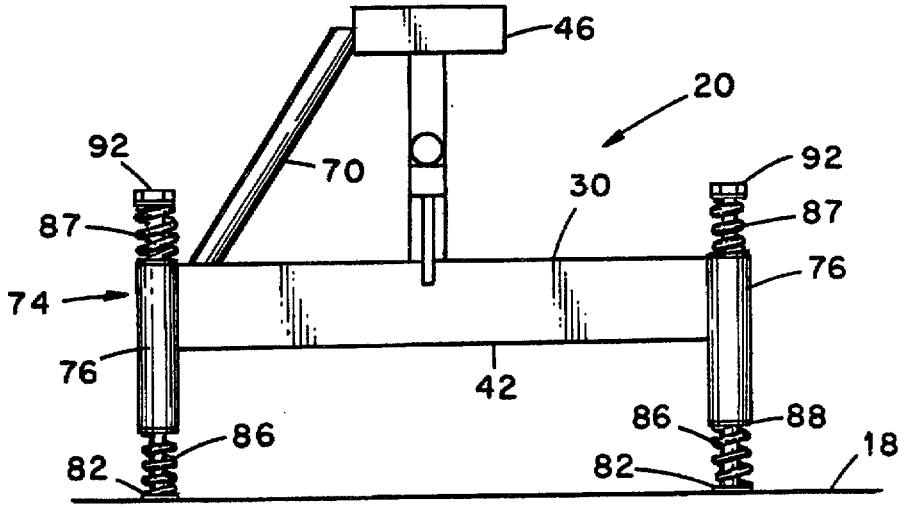
FIG. 3 is an elevational view of the FIG. 1 apparatus, as seen generally from the left in FIG. 2.

With reference to FIGS. 1–3, the apparatus 20 includes a frame 30 having two opposite side section 32, 34 and a front section 36. Each of the side sections 32 and 34 include a main beam 38, 40 or 42 comprised, for example, of steel having a rectangular cross section, and the ends of the main beams 38, 40 or 42 are joined together, as with welds, to form a U-shape arrangement (best seen in FIG. 2) wherein each of the (side) beams 38 and 40 provide a leg portion of the U of the U-shaped arrangement of the frame 30 and the remaining (front) beam 42 provides a bridge portion joining the leg portions of the U-shaped arrangement of the frame 30. For use of the apparatus 20, a user stands within the U of the frame 30 so that each of the side sections 32 or 34 is disposed to a corresponding side of the user and so that the user faces the front section 36. Accordingly, the U-shaped arrangement formed by the beams 38, 40, 42 of the frame 30 is sized to accommodate the user when standing therein, and the front section 36 provides the front of the apparatus 30.

Each component of the frame 30 of the apparatus, as well as every other component of the apparatus 20, unless otherwise indicated, is constructed of steel to enhance the strength and rigidity of the apparatus 20. However, other suitable materials, such as suitable wood products and strong plastics, can be employed instead of steel.

Associated with each side section 32 or 34 is an upstanding assembly 43 including a vertically-oriented post 44 joined at its lower end atop a corresponding beam 38 or 40 (at a location disposed about midway along the length of the beam 40) so as to extend upwardly therefrom. Attached to the upper end of each post 44 is a handle assembly 46 including a U-shaped portion 48 having side plates 49 joined by a bridge section 50 which is, in turn, joined to the upper end of the post 44. In addition, each handle assembly 46 includes an elongated hand grip 52 joined to so as to extend between the side plates 49 of the U-shaped portion 48. For joining the grips 52 to the U-shaped portions 48, each grip 52 includes an interior sleeve 54 having internally-threaded ends, and headed bolts 56 are secured within the threaded ends of the sleeves 54 through openings 58 provided in the side plates 49 of the U-shaped portions 48. To enhance the user's comfort when grasping the grips 52, the interior sleeve 54 is preferably covered with a relatively soft padding.

Also associated with each side section 32 or 34 is a weight-supporting beam 62 which is joined at one of its ends (as with welds) to a corresponding post 44 of the upstanding assembly 43 so as to extend laterally therefrom. The bar 62 is sized (in cross section) to accept the openings of standard-size barbell weights 64 (FIG. 7) directed over the free end, indicated 65 in FIG. 1, of the bar 62, and a headed pin 66 is releasably positionable through an opening 68 provided in the free end 65 to prevent the weights 64 from being removed from the bar 62 unless the pin 66 is removed from the opening 68.

To render the weight of the portion of the frame 30 disposed rearwardly of the hand grips 52 about equal in weight to the portion of the frame 30 disposed forwardly of the hand grips 52, solid steel rods 70 are attached at each end (as with welds) between each (side) beam 38 or 40 and a side plate 49 of the corresponding handle assembly 46 so as to be disposed adjacent the rear of the frame 30. With the weight of the frame 30 distributed accordingly, the rods 70 prevent the frame 30 from being front-heavy, and along these lines, the rods 70 are appropriately sized and attached to the remainder of the frame 30 in the aforedescribed manner so that when the apparatus 20 is raised with the grips 52, the (side) beams 38 and 40 are maintained in a substantially horizontal orientation.

As mentioned earlier, the apparatus 20 is lifted from the floor 18 during the initial moments of the jump phase of the exercise routine and is returned to the floor 18 during the final moments of the rebound phase of the routine. Consequently, the weight of the apparatus 20 is repeatedly lifted and returned to the floor during the performance of the squat-jump exercise routine.

It is a feature of the apparatus 20 that it include means, generally indicated 74, for cushioning the impact between the apparatus 20 and the floor 18 when the apparatus 20 is returned to the floor during the rebound phase of the exercise routine. In the depicted embodiment, the cushioning means 74 includes four spring-biased leg assemblies 76 mounted at the corners of the U-shaped arrangement of the frame 30, as depicted in FIG. 2. In addition and as Will be apparent herein, the structure of the leg assemblies 76 is such that not only is the weight of the apparatus 20 cushioned as it is returned to the floor, but the leg assemblies 76 also cushion the transfer of the weight of the apparatus 20 to the user as the apparatus 20 is lifted from the floor 18.

Figure 4:
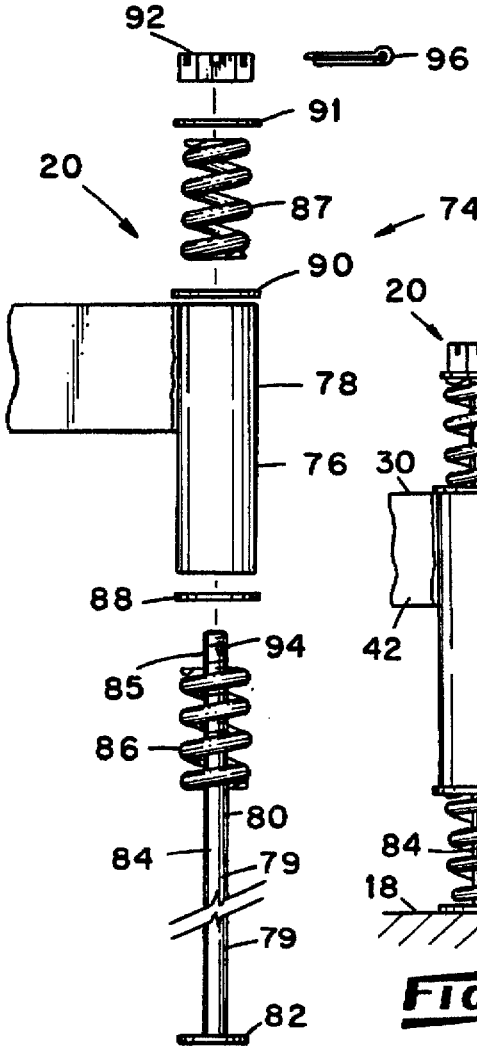
FIG. 4 is a view of a fragment of the FIG. 1 apparatus as viewed in FIG. 3 but drawn to a slightly larger scale and shown exploded.

With reference to FIG. 4, each leg assembly 76 includes a hollow sleeve-like member 78 which is joined (as with welds) to a corresponding corner of the frame so that the through-opening of the sleeve-like member 78 opens upwardly and downwardly. Each leg assembly 76 also includes a leg member 79 in the form of a headed fastener 80 having a head 82 and a shank 84 having a threaded end 85 opposite the head 82. The fastener 80 is positioned within the through-opening of the sleeve-like member 78 so that its head 82 is directed downwardly, and as will be apparent herein, the head 82 of the fastener 80 serves as a foot for engaging the floor 18 and through which the weight of the frame 30 is transferred to the floor. A pair of relatively strong compression springs 86, 87 are arranged below and above, respectively, the sleeve-like member 78 when each leg assembly 76 is assembled, and a flat washer 88, 90 or 91 having a central through-opening is disposed, where appropriate, at a corresponding end of a spring 86 or 87 to provide a surface against which the end of the spring 86 or 87 can act. A nut 92 is threadably securable about the threaded end 85 of the fastener shank 84 to secure the fastener 80 within the sleeve-like member 78 and to secure the springs 86, 87 about the fasteners 80.

To assemble each leg assembly 76 and with reference still to FIG. 4, the fastener 80 is directed shank-end-first through the center of the lower spring 86, through the center of the washer 88, through the through-opening of the sleeve member 78, through the center of the washer 90, through the center of the upper spring 87, and then through the center of the washer 91. The nut 92 is thereafter threaded upon the end of the shank end 84 to secure the fastener 80 and springs 86, 87 in place. In the depicted embodiment 20, a transversely-extending opening 94 is provided in the free end 85 of the fastener shank 84, and a Cotter key 96 is directed through and fastened within the opening 94 to prevent the inadvertent removal or loosening of the nut 92 from the shank 84.

When each leg assembly 76 is in an assembled condition and as best viewed in FIG. 3, portions of the fastener 80 are positioned above and below the sleeve-like member 80 and each of the upper and lower springs 86 and 87 is in a slightly compressed condition as the opposite ends of the lower spring 86 act against the fastener head 82 and the washer 88 (thereby urging the head 82 and washer 88 apart) and the opposite ends of the upper spring 87 act against the washers 90 and 91 (thereby urging the washers 90 and 91 apart). Preferably, the springs 86 and 87 are of substantially equal length and strength so that when the apparatus 20 is completely lifted from the floor 18 so that no weight of the frame 30 is supported by the leg assemblies 76, the head 82 of the fastener 84 and the nut 92 are about equally spaced from the corresponding end of the sleeve-like member 78.

Figures 5A, 5B, 5C:
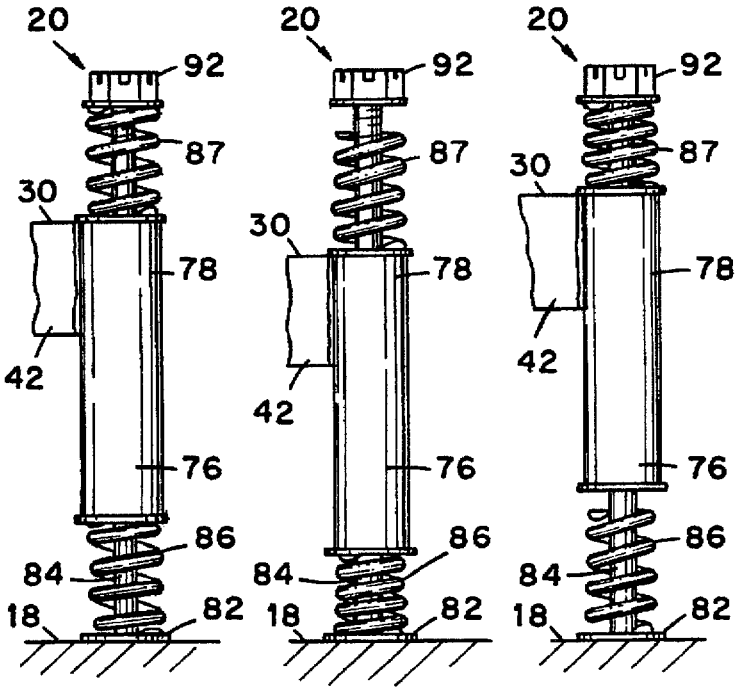
FIGS. 5*a*–5*c* are views of the fragment of FIG. 4 shown in an assembled condition and illustrating the various positions of components of the apparatus relative to one another.

Within each leg assembly 76, the lower spring 86 continually biases the head 82 of the fastener 80 (in a downward direction) relative to the sleeve-like member 78 from a retracted condition, as illustrated in FIG. 5*b*, to an extended condition, as illustrated in FIG. 5*a*. During use, the spring 86 is permitted to compress to the FIG. 5*b* condition upon application of a sufficient downwardly-directed force to the apparatus frame 30 and when the fastener head 82 is in engagement with the floor 18 so that the biasing force of the spring 86 is overcome. Such a compression of the springs 86 will most likely occur when the apparatus 20 is impacted fastener-head-first against the floor at the end of a rebound phase of the exercise routine.

By comparison, the upper spring 87 of each leg assembly 76 continually biases the nut 92 of the leg assembly 76 (in an upward direction) relative to the sleeve-like member 78 from a retracted condition, as illustrated in FIG. 5*c*, to an extended condition, as illustrated in FIG. 5*a*. During use, the spring 87 is permitted to compress toward the FIG. 5*c* condition upon application of a sufficient force which urges the nut 92 and apparatus frame 30 toward one another (as may be the case during an upward-directed bounce of the apparatus frame 30 from its position to the fastener head 82 illustrated in FIG. 5*b*).

Figure 6:
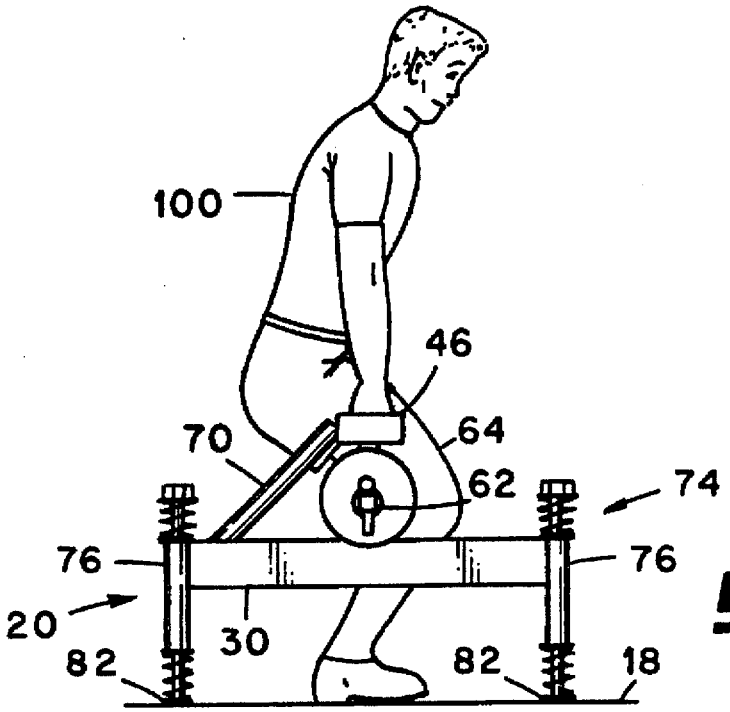
FIGS. 6 and 7 are views, as seen from the side, of the FIG. 1 apparatus being used during a squat jump exercise.

To use the apparatus 20 and with reference to FIG. 6, a user, indicated 100, stands within the U of the U-shaped arrangement of the apparatus frame 30 so as to face forwardly thereof and grasps the grips 52 of the handle assemblies 76 with his hands. The height of the grips 52 as measured from the floor 18 is such that the user 100 must squat from a standing position (to about a one-half squat) in order to grasp the grips 52. With the hands firmly grasped about the grips 52, the user 100 leaps from the floor 18 with sufficient force to raise the apparatus 20 from the floor 18 and so that, if possible, his feet clear the floor 18 as depicted in FIG. 7.

At the outset of the jump phase of the squat-jump exercise routine during which the weight of the apparatus 20 is transferred from the floor 18 to the user's hands, the upper springs 87 are permitted to compress slightly in response to the sudden upward jerk of the apparatus 20 by way of the grips 52. Such a permitted compression of the springs 87 serve to cushion, to a degree, the transfer of the weight of the apparatus 20 to the hands during the jump phase of the exercise routine and are advantageous in this respect.

Figure 7:
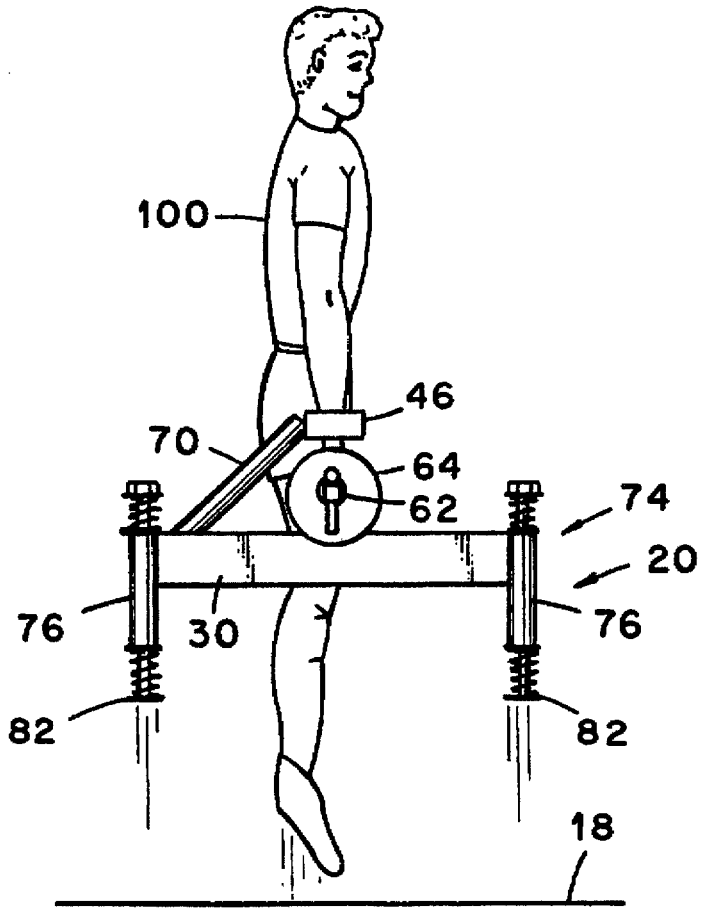

When the user 100 reaches the peak of his jump, his legs and back are relatively straight as illustrated in FIG. 7. Upon his return to the floor 18 under the influence of gravity (and toward the original squat position of FIG. 6) during the subsequent rebound phase of the routine, the user's feet make contact with the floor 18 and the user's back and legs are thereafter permitted to bend at the waist and knees under the weight of the apparatus 20. When the user's hands reach a sufficiently low elevation during the rebound phase of the routine, the heads 82 of the fasteners 80 strike the floor 18 and the lower springs 86 compress (under the weight of the remainder of the apparatus 20) toward the condition illustrated in FIG. 5*b* to arrest the downward movement of the apparatus frame 30. It follows that during the rebound phase of the routine during which the apparatus 20 is returned into engagement with the floor 18, the downward motion of the apparatus frame 30 is decelerated by the springs 86 to zero over a distance equal to about the difference between the length of the spring 86 when expanded and the length of the spring 86 when compressed. In addition, since it is the springs 86, rather than the user's muscles, which can be relied upon to decelerate the downward motion of the apparatus frame 30 to zero, the leg assemblies 76 reduce the stress on the user's muscles and reduce the likelihood of undue stress on the user's joints during the rebound phase of the squat-jump exercise routine.

It also follows that following the compression of the springs 86 at the end of a rebound phase of the routine, the apparatus frame 30 bounces from the floor 18 in a manner which (for a brief period) directs the weight of the frame 30 upwardly. During a number of repetitions of the squat-jump exercise routine performed with the apparatus 20 during which the user jumps upwardly from a squat position and returns to a squat position in preparation of a jump phase of the routine, the user can appropriately time his jump so that his lift of the apparatus 20 is initiated during the aforedescribed period during which the weight of the frame 30 is bounced upwardly and so that this bounce facilitates the lift of the apparatus 20 during the jump phase of the routine and reduce stress on the user's joints (e.g. the joints of the knees, arms and hips) during the jump phase. Preferably, the jump and rebound phases of the routine are performed as smoothly as possible, with little or no hesitation or jerky motions during the phases of the routine. It has been found that users who have exercised routinely with the apparatus 20 in this manner have experienced a marked increase in the height of their vertical jump.

Exemplary dimensions of the apparatus 20 are as follows: The width of the apparatus 20 as measured across the front section 36 is about 29.5 inches; the depth of the apparatus as measured along either side section 32 or 34 is about 19.5 inches; the height of each leg assembly 76 as measured along the length of the fastener 80 is about 8.5 inches; each hand grip 52 is about 14.5 inches from the floor when the apparatus 20 rests thereon; the length of each portion of the fastener 80 which extends above and below the sleeve-like member 78 is about 1.5 inches; the length of each weight-supporting bar 62 is about 1.5 inches, and each bar 62 has a square cross section measuring 1.5 inches along each side; and the shank of each fastener 80 is about 1.0 inches in diameter. In addition, the compression springs 86 and 87 are sized to collectively cushion the impact of the apparatus 20 against the floor during the exercise routine.

It will be understood that numerous modifications and substitutions can be had to the aforedescribed embodiment without departing from the spirit and scope of the invention. For example, although the aforedescribed embodiment 20 has been shown and described as including a front section 36 bounded by a pair of leg assemblies 76, an apparatus in accordance with the present invention may include a single leg assembly attached to the front section 36 so as to be positioned substantially midway between the ends thereof. Accordingly, the aforedescribed embodiment is intended for the purpose of illustration and not as limitation.

What is claimed is:

1. An apparatus for use during the performance of a squat-jump type of exercise routine wherein the exercise routine includes a jump phase during which the user lifts the apparatus from the floor and a rebound phase during which the user returns the apparatus to the floor, the apparatus comprising:

a frame within which a user stands for the performance of a squat-jump type of exercise routine and including hand grips with which the apparatus is lifted from the floor by the user during the jump phase of the exercise routine and is returned to the floor during the rebound phase of the exercise routine wherein the hand grips are connected to the frame and disposed on opposite sides of the user as the user stands within the frame wherein the frame includes a front, a rear, and a beam which extends between the front and the rear of the frame on each side of the user;

leg members for engaging the floor and through which the weight of the frame is transferred to the floor when the apparatus is rested thereon, the leg members being connected to the frame so that each leg member is movable relative to the frame between an extended condition and a retracted condition; and means associated with the frame for biasing the leg members from the retracted condition toward the extended condition so that when the apparatus is in a spaced relationship above the floor, the leg members are maintained in the extended condition by the biasing means and so that when the apparatus is lowered to the floor during the rebound phase of the exercise routine, the leg members engage the floor and are permitted to move relative to the frame toward the retracted position under the weight of the frame and in opposition to the force of the biasing means to thereby cushion the impact of the apparatus against the floor.

2. The apparatus as defined in claim 1 wherein each leg member is elongated in form and is connected to the frame for movement relative thereto between the extended and retracted conditions along a path corresponding generally with the longitudinal axis of the leg member.

3. The apparatus as defined in claim 2 wherein each leg member is arranged so that its longitudinal axis is oriented substantially vertically and so that each leg member moves relative to the frame between the retracted and extended conditions along a substantially vertical path.

4. The apparatus as defined in claim 1 wherein the biasing means includes at least one spring which is disposed so as to act between each leg member and the frame and the at least one spring accommodates a bounce of the apparatus frame away from the floor following engagement of the leg member with the floor during the rebound phase of the exercise routine.

5. The apparatus as defined in claim 1 further including a sleeve-like member fixedly joined to the frame and having an opening therein which is oriented generally vertically, and one of the leg members has a portion which is positioned within the opening of the sleeve-like member for movement along the length thereof between the retracted and extended conditions.

6. The apparatus as defined in claim 5 wherein the opening of the sleeve-like member is a through-opening which opens below and above the sleeve-like member, the leg member includes a foot which extends out of the sleeve-like member so as to be disposed below the opening provided therein and another portion which extends out of the sleeve-like member so as to be disposed above the opening provided therein, and the biasing means includes a first spring which acts between the foot and the sleeve-like member and a second spring which acts between said another portion of the leg member and the sleeve-like member.

7. The apparatus as defined in claim 1 wherein the hand grips are disposed at such a height relative to the floor upon which the apparatus rests between exercise routines so that in order for the user to grasp the hand grips for use of the apparatus while standing within the frame and upon the floor, the user must assume a squat position.

8. The apparatus as defined in claim 1 wherein the apparatus frame includes a front portion disposed forwardly of the hand grips and a rear portion disposed rearwardly of the hand grips, and the weight of the frame is distributed between the front and rear portions so that the weight of the front portion is about equal to the weight of the rear portion.

9. The apparatus as defined in claim 1 wherein each beam is oriented substantially horizontally when the apparatus rests upon the floor, and the weight of the apparatus frame is distributed relative to the hand grips so that when the apparatus frame is lifted from the floor by the hand grips, each beam of the frame is maintained in a substantially horizontal orientation.

10. An apparatus for use during the performance of a squat-jump type of exercise routine involving a jump phase during which the user jumps and lifts the apparatus from the floor and a rebound phase during which the user and the apparatus are returned to the floor, the apparatus comprising:

a frame within which a user stands for the performance of a squat-jump type of exercise routine and including side sections disposed on opposite sides of the user as the user stands within the frame for performance of the exercise routine, and the side sections include hand grips mounted thereon with which the apparatus is grasped by the hands of the user and lifted from the floor during the jump phase of the exercise routine and returned to the floor during the rebound phase of the exercise routine wherein the frame includes a front and a rear, each side section of the frame includes a beam which extends between the front and the rear of the frame;

leg assemblies connected to the frame and including leg members for engaging the floor when the apparatus is rested thereon and through which the weight of the frame is transferred to the floor, the leg members being associated with the frame so that each leg member is movable relative to the frame between an extended condition and a retracted condition; and means associated with the frame for biasing each leg member from its retracted condition toward its extended condition so that when the apparatus is in a spaced relationship above the floor, each leg member is maintained in the extended condition by the biasing means and so that when the apparatus is lowered to the floor during the rebound phase of the exercise routine, the leg members engage the floor and are permitted to move relative to the frame toward the retracted position under the weight of the frame and in opposition to the force of the biasing means to thereby cushion the impact of the apparatus against the floor during the rebound phase of the exercise routine.

11. The apparatus as defined in claim 10 wherein the biasing means includes at least one spring which is disposed so as to act between each leg member and the frame and the at least one spring accommodates a bounce of the apparatus frame away from the floor following engagement of the leg member with the floor during the rebound phase of the exercise routine.

12. The apparatus as defined in claim 10 wherein each leg assembly includes a sleeve-like member having an opening therein and which is fixedly joined to the apparatus frame so that its opening is directed in at least a downward direction, and wherein the downwardly-directed opening of the sleeve-like member accepts a portion of a corresponding leg member for movement of the leg member between the extended and retracted conditions.

13. The apparatus as defined in claim 12 wherein each leg member is elongated in form and is arranged within the sleeve-like member so that its longitudinal axis is oriented substantially vertically and so that each leg member moves relative to the frame between the retracted and extended conditions along a substantially vertical path.

14. The apparatus as defined in claim 12 wherein the opening of the sleeve-like member is a through-opening which opens below and above the sleeve-like member, the leg member includes a foot which extends out of the sleeve-like member so as to be disposed below the opening provided therein and another portion which extends out of the sleeve-like member so as to be disposed above the opening provided therein, and the biasing means includes a first spring which acts between the foot and the sleeve-like member and a second spring which acts between said another portion of the leg member and the sleeve-like member.

15. The apparatus as defined in claim 10 wherein the frame includes a U-shaped arrangement having two leg portions joined by a bridge portion, and each side section includes a leg portion of the U-shaped arrangement of the frame.

16. The apparatus as defined in claim 15 wherein at least one leg assembly is associated With a leg portion of the U-shaped arrangement so that when the apparatus is positioned upon the floor and its weight is fully supported by the leg members, the weight of each leg portion of the U-shaped arrangement is at least partially supported by the leg member of the corresponding leg assembly.

17. The apparatus as defined in claim 16 wherein each leg portion of the U-shaped arrangement of the frame includes two opposite ends, and the apparatus includes two leg assemblies associated with each leg portion of the U-shaped arrangement of the frame wherein each of the two leg assemblies is disposed adjacent a corresponding end of the leg portion.

18. The apparatus as defined in claim 10 wherein the hand grips are disposed at such a height relative to the floor upon which the apparatus rests between exercise routines so that in order for the user to grasp the hand grips for use of the apparatus while standing within the frame and upon the floor, the user must assume a squat position.

19. The apparatus as defined in claim 10 wherein the apparatus frame includes a front portion disposed forwardly of the hand grips and a rear portion disposed rearwardly of the hand grips, and the weight of the frame is distributed between the front and rear portions so that the weight of the front portion is about equal to the weight of the rear portion.

20. The apparatus as defined in claim 10 wherein each beam is oriented substantially horizontally when the apparatus rests upon the floor, and the weight of the apparatus frame is distributed relative to the hand grips so that when the apparatus frame is lifted from the floor by the hand grips, the beams of each side section are maintained in a substantially horizontal orientation.

* * * * *